United States Patent [19]

Ishii

[11] 4,329,680

[45] May 11, 1982

[54] DOUBLE GONG BELL

[75] Inventor: Tadashi Ishii, Kunitachi, Japan

[73] Assignee: Kobishi Electric Co., Ltd., Tokyo, Japan

[21] Appl. No.: 189,674

[22] Filed: Sep. 22, 1980

[51] Int. Cl.[3] ..... G10K 1/064

[52] U.S. Cl. ..... 340/396; 340/392; 340/402; 116/152

[58] Field of Search ..... 340/392, 396, 402; 116/152

[56] References Cited

U.S. PATENT DOCUMENTS

| | | | |
|---|---|---|---|
| 2,205,189 | 6/1940 | Edwards | 340/392 |
| 2,217,073 | 10/1940 | Obergfell | 340/392 |
| 3,076,960 | 2/1963 | Knutson | 340/402 |
| 3,435,450 | 3/1969 | Pena | 340/392 |
| 4,183,018 | 1/1980 | Sakaguchi | 340/396 |

*Primary Examiner*—Harold I. Pitts
*Attorney, Agent, or Firm*—Darby & Darby

[57] ABSTRACT

A double gong bell has an outer gong and an inner gong separately arranged to accommodate the inner gong within the space defined by the inner surface of the outer gong. In one embodiment at least two hammer driving members, disposed within the space defined by the inner surface of the outer gong and slidably supported within a mounting means are adapted for reciprocal movement upon the action of a hammer driving means. The ends of the hammer driving members closest to the gongs are attached to a first resilient member and a hammer. A pair of second resilient members attached to the hammer driving members and the mounting means are biased to urge the hammers to strike the inner and outer gongs upon the action of the hammer driving means generating a bell sound having composite tone colors.

7 Claims, 4 Drawing Figures

DOUBLE GONG BELL

BACKGROUND OF THE INVENTION

This invention relates to double gong bells capable of generating a bell sound having composite tone colours therein.

A typical arrangement of a conventional bell is made of a single gong, a hammer for striking the gong surface to generate a bell sound, and a driving mechanism by which the hammer is actuated to move reciprocally against the gong surface: the driving mechanism being of the type in which either a motor drives a hammer through a transmission device or an electro-magnetic coil energizes directly a hammer to strike a gong.

This known bell has been found not entirely satisfactory in that the bell produces only a monotonous sound originating from an oscillation of the single gong whose natural resonance frequency is inherently determined by the material, shape, thickness or the like. As a result, the tone colour of the bell sound is fixed at a certain quality having a predetermined frequency and intensity, without substantially changing sound waveshape or envelope.

SUMMARY OF THE INVENTION

It is therefore an principal object of this invention to provide a double gong bell of the type which is capable of generating a bell sound having composite tone colours therein.

Briefly, a double gong bell according to the invention is comprised of an outer gong and an inner gong so that the bell can generates a bell sound of composite tone colours having therein two different frequencies which are originated from the respective gongs.

More in particular, according to the present invention there is provided a double gong bell which comprises:

two gongs made of an outer gong and an inner gong separately arranged to accommodate said inner gong within the space defined by the inner surface of said outer gong; at least one hammer means disposed within said space and adapted to reciprocally strike said inner and outer gongs; and hammer driving means for moving said hammer reciprocally back and forth relative to said gongs to strike and generate a bell sound.

Other advantages, features and additional objects of the present invention will become manifest to those versed in the art upon making reference to the detailed description and the accompanying sheets of drawings in which preferred embodiments incorporating the principles of the present invention are shown by way of illustrative examples.

DESCRIPTION OF THE PREFERRED EMBODIMENTS

Figure 1:
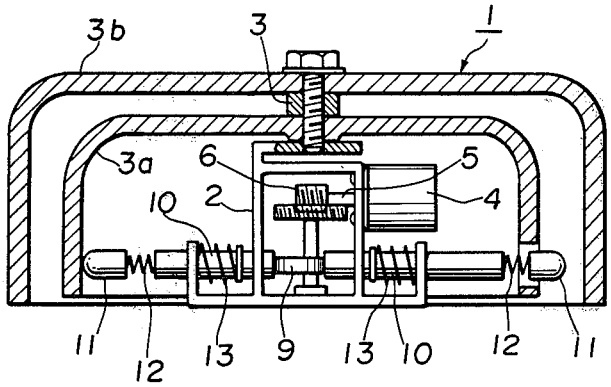
FIG. 1 is a cross sectional view of a double gong bell according to a first embodiment of this invention.
Figure 2:
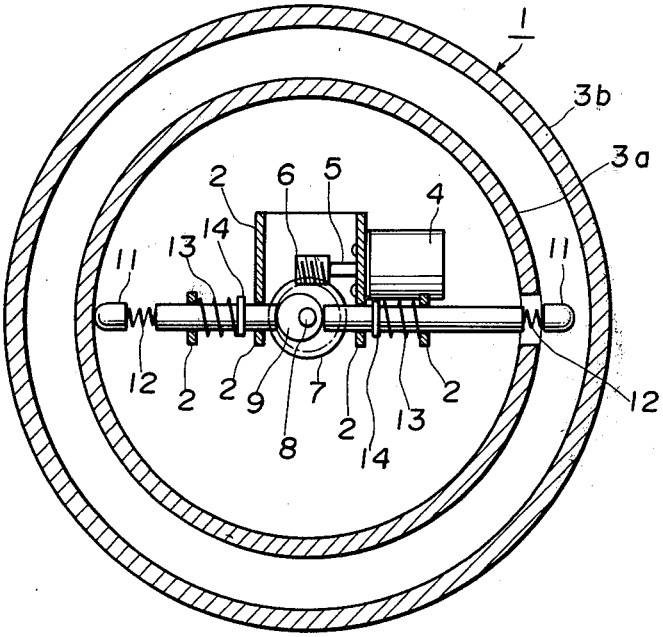
FIG. 2 is a schematic plan view of the bell as shown in FIG. 1.

FIGS. 1 and 2 show a double gong bell 1 constructed in accordance with a first embodiment of the invention. The bell 1 comprised of two gongs, i.e., an inner gong 3*a* and an outer gong 3*b* which are fixed with each other by an appropriate fixing means such as a bolt and nut, the nut 3 being employed to keep a certain clearance between the inner and outer gongs. At the center of the inner gong 3*a*, the end of the bolt is extended to the inner surface of the gong 3*a* where a mounting plate 2 is fixed for accomodation of each mechanical element which constitutes the bell 1. The gongs 3*a* and 3*b* are made of iron in the form of a cup or a semisphere. An electric motor 4 is fixedly mounted on the mounting plate 2 by screws, the motor 4 having a shaft 5 capable of continuous rotation in accordance with its drive current. A worm gear 6 is fixedly mounted on the drive shaft 5 for rotation therewith and is operatively mated with a worm wheel 7 which is fixedly mounted on a supporting shaft 8 at one end thereof, the supporting shaft 8 being supported on the mounting plate 2 in rotational relation therewith. Adjacent to the other end of the supporting shaft 8, there is provided an eccentric cam 9 which is fixedly secured to the supporting shaft 8 for rotation thereabout, the eccentric cam 9 being arranged to contact with two hammer driving members 10, 10 at an arcuate surface of the cam 9 which is capable of serving as a cam surface.

The two hammer driving members 10, 10 are respectively supported through each two bores formed in the mounting plate 2, which enables the hammer driving members 10, 10 to move reciprocally in relation with the inner surfaces of the gongs 3*a* and 3*b*. One of the hammer driving members 10 shown at the right side half of FIG. 1 extends through a bore formed in the skirt of the inner gong 3*a* to the surface of the outer gong 3*b* so that the hammer 11 at the right can strike the outer gong 3*b*, while the other hammer at the left is so arranged to strike the inner gong 3*a*.

As a result, two hammers 11, 11, each respectively connected at the end of the two hammer driving members 10, 10 by means of resilient members 12, 12 such as springs, are capable of striking the gong surfaces of the respective inner and outer gongs to generate a bell sound in accordance with the movement of the cam 9 surface which urges to push the hammer driving members 10, 10 back and forth relative to the gong surfaces. It should be noted that there is provided other resilient members 13, 13 which are respectively connected at one end thereof to collar rings 14, 14 secured around the hammer driving members 10, 10, and are respectively disposed to abut freely against the walls of the mounting plate 2 at the other end of the resilient members 13, 13. The resilient members 13, 13 such as springs act on the hammer driving members 10, 10 to impart resilient force thereto through the collar rings 14, 14 so that, when the hammer driving members 10, 10 are expelled in a forward direction relative to the gong surface, the hammer driving members 10, 10 are subjected to a reverse-force exerted from the resilient members 13, 13 in a backward direction relative to the gong surface thereby maintaining the hammer driving members 10, 10 to abut continuously against the cam 9 surface during its operation.

The operation of the motor actuated bell thus constructed will be described.

Upon energization of the electric motor 4, its rotary shaft 5 is rotated so that the worm gear 6 is urged to rotate around the shaft 5. The worm gear 6 which is operatively mated with the worm wheel 7, in turn, urges to rotate the worm wheel 7 thereby causing the supporting shaft 8 to rotate around itself. As a result, the eccentric cam 9 rotates in contact relation with the both hammer driving members 10, 10. As the eccentric cam 9 is formed in offset relation with the cam center, the rotation of the cam 9 gives reciprocal movement to the hammer driving members where the cam 9 and the hammer driving members 10, 10 are continuously maintained in contact with each other. Each time the hammer driving member 10 is expelled toward the gong 3*b* as is shown in FIG. 1 at the right side thereof, the hammer 11 at the right strikes the gong 3*b* while the hammer 11 at the left is kept apart from the gong 3*a* surface. The number of gong striking is accordingly two times that of the rotation of the cam 9 about the shaft. In this case it is to be noted that the sound generated by the inner gong 3*a* and the sound generated by the outer gong 3*b* differ each other in frequency so that the resultant sound is perceived having composite sound colours, that is, the sound waveshape includes a beat frequency therein resulting in generation of somewhat different sound colour from that of a single gong.

Figure 3:
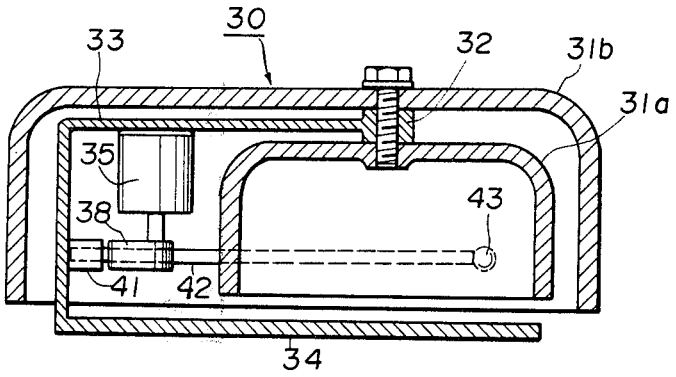
FIG. 3 is a cross sectional view of a double gong bell according to a second embodiment of this invention.
Figure 4:
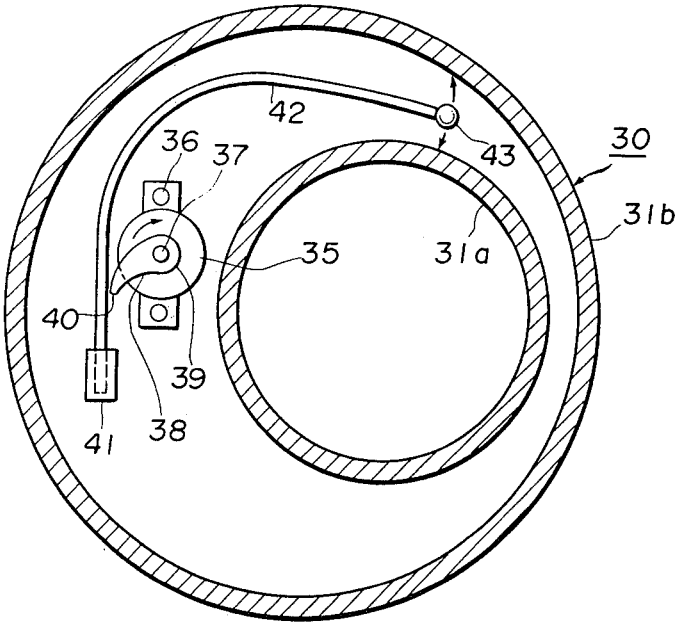
FIG. 4 is a schematic plan view of the bell as shown in FIG. 3.

Referring now to FIGS. 3 and 4, there is shown a double gong bell 30 constructed in accordance with a second embodiment of the invention. The bell 30 is comprised of two gongs, i.e., an inner gong 31*a* and an outer gong 31*b* which are fixed in an eccentric arrangement with each other by an appropriate fixing means such as a bolt. The clearance between the inner gong 31*a* and the outer gong 31*b* is held constant by means of a spacer 32 which is fixed to the bolt. The spacer 32 extends integrally to form a mounting plate 33 which serves at its bottom as a fixing plate 34 for mounting the bell 30. An electric motor 35 is fixedly mounted on the mounting plate 33 by screws 36, the motor having a drive shaft 37 capable of continuous rotation in a clockwise direction (FIG. 4). A cam member 38 is fixedly mounted on the drive shaft 37 for rotation therewith. The cam member has a base portion 39 of generally circular shape and a cam portion 40 extending outwardly from the base portion. The cam portion 40 has an arcuate surface on one side thereof which is capable of serving as a cam surface.

A mounting block 41 formed therein a retainer hole for snugly receiving and holding one end of an elongated lever 42 is fixedly secured to the mounting plate 34. The lever 42 has a hammer or striking element 43 attached to the other end of the lever. The lever and ball are made of metal, and in addition the lever 42 is composed of a resilient material.

As shown in FIG. 3, the lever 42 and the cam member 38 are disposed generally in a common plane parallel to the plane of the mounting plate 33. The lever 42 is disposed in such a manner that the cam portion 40 is engageable with the lever intermediate the opposite ends thereof. Moreover, the hammer 43 is so arranged to be normally located between the outer gong 31*b* and the inner gong 31*a*.

In operation, the motor 35 is first driven through a power source (not shown) to rotate the cam member 39 in a clockwise direction to permit the cam surface to engage the lever 42 intermediate its opposite ends so that the cam member 39 urges the resilient lever 42 against the bias thereof to move in a counterclockwise direction, with the hammer 43 being moved toward the outer gong 31*b* to strike it. The cam member 39 continues to rotate clockwise and is brought out of engagement with the lever 42 whereupon the resilient lever is caused to move in a clockwise direction by its own resilient force so that the hammer 43 strikes the inner gong 31*a* to produce sound. This cycle of operation is continuously repeated to impart a swinging motion to the hammer 43 so as to produce bell sound of the required volume. It is also true in this case as seen from the first embodiment that the sounds generated by the inner gong 31*a* and 31*b* differ each other in frequency so that the resultant sound is perceived having composite sound colours, i.e., the sound waveshape includes a beat frequency therein resulting in generation of somewhat different sound colour from that of a single gong.

As is described above, it is a feature of the invention to provide a double gong bell in which a bell sound having composite tone colours therein is generated from the inner and outer gongs.

Having described our invention as related to the embodiments shown in the accompanying drawings, it is our intention that the invention is not limited by any of the details of description, unless otherwise specified, but rather is construed broadly within its spirit and scope as set out in the accompanying claims.

What is claimed is:

1. A double gong which comprises:

an outer gong and an inner gong separately arranged to accomodate said inner gong within a space defined by the inner surface of said outer gong;

means for slidably mounting at least two hammer driving members, said mounting means being positioned within a space defined by the inner surface of said inner gong and being formed with at least two pairs of apertures;

at least two hammer driving members disposed within the space defined by the inner surface of said outer gong, each of said hammer driving members being slidably positioned within said mounting means and having a first end closest to the inner surface of said gongs fixed to first end of a first resilient member;

each of said first resilient members being attached at a second end thereof to a hammer adapted to reciprocally strike said inner and outer gongs;

at least one pair of second resilient members, each of said second resilient members being adapted to act in conjunction with a hammer driving means to cause the hammers to reciprocally strike the inner and outer gongs, each of said second pair of resilient members being fixed at a first end to a point on said mounting means closest to said gongs and at a second end to a point on said hammer driving member intermediate one pair of the apertures formed in said mounting means; and hammer driving means for moving said hammers reciprocally relative to said gongs to strike them and generate a bell sound.

2. A double gong bell according to claim 1, in which said inner gong is positioned in concentric allignment with said outer gong.

3. A double gong bell according to claim 1, in which said inner gong is positioned away from the center axis of said outer gong.

4. A double gong bell according to claim 2, in which said hammer driving means comprises:

an electric motor having a drive shaft;

transmission means for transmitting the rotational movement of said shaft to a second supporting shaft; and a cam member fixedly mounted on the second supporting shaft, the surface of said cam member being in continuous contact with the second ends of said hammer driving members located furthest from said hammers, such that the hammer driving members are capable of moving reciprocally in relation to said gongs upon the operation of the motor by a biased force of each of said second resilient members; and further where said second resilient members transmit the reciprocal movement of said hammer driving members to said hammers thereby causing said hammers to strike said inner and outer gongs generating a bell sound having composite tone colors.

5. A double gong bell according to claim 4, in which said transmission means comprises a worm gear fixedly mounted on the drive shaft, and a worm wheel fixedly mounted on the second supporting shaft to mate with the worm gear.

6. A double gong bell according to claim 4, in which said cam member is an eccentric cam whose arcuate surface contacts continuously with the ends of said hammer driving means.

7. A double gong which comprises:

an outer gong and an inner gong arranged in spaced apart eccentric relation to accomodate said inner gong within a spaced defined by the inner surface of said outer gong;

means for mounting a resilient lever within a space defined by the inner surface of said outer gong and the outer surface of said inner gong;

the resilient lever having a first end fixed to said mounting means and a second end attached to a hammer;

an electric motor having a drive shaft, said motor being attached to said mounting means and being located within the space defined by the inner surface of said outer gong and the outer surface of said inner gong; and a cam means connected to the drive shaft of said motor, said cam means being in position to engage said resilient lever intermediate the ends thereof upon operation of said motor and drive shaft such that the cam means urges the resilient lever for reciprocal movement urging said hammer into striking contact with said inner and outer gongs generating a bell sound.

* * * * *